US006093367A

United States Patent [19]

Barboni et al.

[11] Patent Number: 6,093,367

[45] Date of Patent: Jul. 25, 2000

[54] AUTOMATIC PLANT FOR THERMAL TREATMENT OF METALS, IN PARTICULAR STEEL

[75] Inventors: Luciano Barboni, Agrate Brianza; Junio Barcaglioni, Pessano Con Bornago, both of Italy

[73] Assignee: Refrattari Brebbia S.R.L., Italy

[21] Appl. No.: 09/346,319

[22] Filed: Jul. 2, 1999

[51] Int. Cl.[7] ..... C21D 1/06

[52] U.S. Cl. ..... 266/252; 266/274

[58] Field of Search ..... 266/249, 252, 266/256, 259, 274

[56] References Cited

U.S. PATENT DOCUMENTS

| | | | |
|---|---|---|---|
| 3,553,414 | 1/1971 | McArthur | 266/249 |
| 3,866,891 | 2/1975 | Kalbfleisch | 266/249 |
| 4,480,822 | 11/1984 | Mauratelli | 266/256 |

FOREIGN PATENT DOCUMENTS

| | | |
|---|---|---|
| 167102 | 11/1950 | Austria . |
| 0296102 | 5/1993 | European Pat. Off. . |
| 0481167 | 1/1996 | European Pat. Off. . |
| 0388333 | 7/1994 | France . |

*Primary Examiner*—Scott Kastler

*Attorney, Agent, or Firm*—Robert F. I. Conte; Lee, Mann, Smith, McWilliams, Sweeney & Ohlson

[57] ABSTRACT

An automatic plant for thermal treatments of metal materials, in particular steel materials, is provided which comprises work stations (3, 4, 5, 6) having chambers (4*a*, 5*a*, 6*a*) with a well-shaped conformation, a flat bearing structure (7) in superposed relationship with the work stations, a movable assembly (8) provided with a slidable plate-like base (9) close to the bearing structure (7), at least one bell-shaped region (10) formed in the plate-like base (9) and adapted to house a charge-holding basket (18), and at least one vertical-movement device (12) adapted to move the basket (18) from an inner position to an outer position relative to the bell-shaped region itself (10).

15 Claims, 2 Drawing Sheets

AUTOMATIC PLANT FOR THERMAL TREATMENT OF METALS, IN PARTICULAR STEEL

FIELD AND BACKGROUND OF THE INVENTION

The present invention relates to an automatic plant for thermal treatments of metals, in particular steel metals.

It is known that plants having a batch operation for thermal treatments of steel metals in a controlled atmosphere comprise a varying number of work stations among which, in addition to a series of stations or stands for loading-unloading charge-holding baskets, provision is made for one or more reheating and/or high-temperature thermochemical-treatment chambers or furnaces, one or more tempering and/or low-temperature thermochemical-treatment chambers or furnaces, one or more cooling or hardening stations, and one or more washing or rinsing stations.

Charge-holding baskets extending both horizontally and vertically are currently transported in plants of known type provided with work chambers having the conformation of a room, i.e. in which the loading and unloading opening is positioned at the lower part of same, by transfer tables sliding on tracks or by sliding grid conveyors at the outside and inside of tightly sealed chambers in which all work stations requiring to operate in a controlled atmosphere are housed.

The known art briefly described above however has many limits and drawbacks.

This technique in fact highlights a great rigidity in the range of the treatments It offers because the necessarily limited number of work stations susceptible of alignment within a Lightly sealed chamber needs important and expensive plant modifications and often special dedicated plants for being increased and adapted to the new operating requirements.

In addition, the controlled-atmosphere volumes of the spaces necessary for charge transferring are very extended even for few work stations, and therefore consumption of technical gases that need to be present in these spaces for supply of the controlled atmosphere of different types is also very important.

It is to be added that known plants, in which actuation of the charge-holding baskets takes place by sliding, reduce the possibility of filling these structures with important weights due to deformation and wear of the structures themselves and the related sliding guides. Also due to the fact that the actuation means of the charge-holding baskets is located at areas subjected to critical temperatures and temperature changes, strong stresses occur that limit the maximum amount of the loads that can be carried.

Finally, arrangement of the stations within the tightly sealed chambers makes it difficult to accede thereto for both ordinary and extraordinary servicing interventions.

Beside the above described plants, also known are plants of vertical extension in which furnaces hanging from an overhead rail slide and get aligned at the various work stations. In these plants elevator-provided loading-unloading apparatuses and hooking-releasing devices positioned on each of the lower stations are contemplated.

This second plant typology clearly shows a great construction complexity, as it is necessary to handle a plurality of furnaces in order to maximize the operating flexibility of the plant. In addition, in this case too, the actuation means operating within each furnace undergoes important thermal stresses limiting the maximum transportable loads. On the other hand, it is impossible to think of working with too heavy loads since overhead furnaces cannot be of too big sizes as they must be conveniently supported and handled and thermally insulated in an efficient manner.

As regards safety too, it is apparent that the presence of overhead moving furnaces is not a particularly desirable situation.

SUMMARY OF THE INVENTION

Under this situation, the technical task underlying the present invention is to devise an automatic plant for thermal treatments capable of substantially eliminating all the above mentioned drawbacks.

Within the scope of this technical task it is an important aim of the invention to devise an automatic plant of great versatility enabling a great variety of thermal treatments to be carried out without the use of special dedicated plants, possibly replacing or adding work stations without particular cost increases and also enabling treatment typologies different from each other on the various charges to be carried out in sequence or simultaneously.

Another important aim of the invention is to devise a plant enabling running costs to be limited, in particular by optimizing consumption of technical gases necessary to create the controlled atmosphere provided for each process.

A further aim of the invention is to devise a reliable plant which is sure for the operators assigned thereto and the environment as well, and which is of easy and quick maintenance.

A still further aim of the invention is to devise a plant of simple structure enabling operation at low temperatures of the charge-handling means, thereby avoiding problems of deformation and wear even when considerable weights are housed in the charge-holding structures or baskets.

The technical task mentioned and the aims specified are substantially achieved by an automatic plant for thermal treatments of metal materials, in particular steel materials, comprising at least one loading/unloading station and work stations provided with chambers having a well-shaped conformation, said plant further comprising: a flat bearing structure extending horizontally and in superposed relationship with said stations, and—a movable assembly provided with a slidable plate-like base close to said flat bearing structure and adapted to be disposed at predetermined operating positions, said plate-like base having at least one first substantially bell-shaped region adapted to house a charge-holding basket, and said movable assembly comprising, for each said bell-shaped region, a vertical-movement device to move the basket between an inner upper position and an outer lower position relative to the bell-shaped region itself.

BRIEF DESCRIPTION OF THE DRAWINGS

Description of two preferred, non exclusive embodiments of an automatic plant for thermal treatment of metal materials is now given hereinafter by way of non-limiting example, with reference to the accompanying drawings, in which.

DESCRIPTION OF THE PREFERRED EMBODIMENTS

Figure 1:
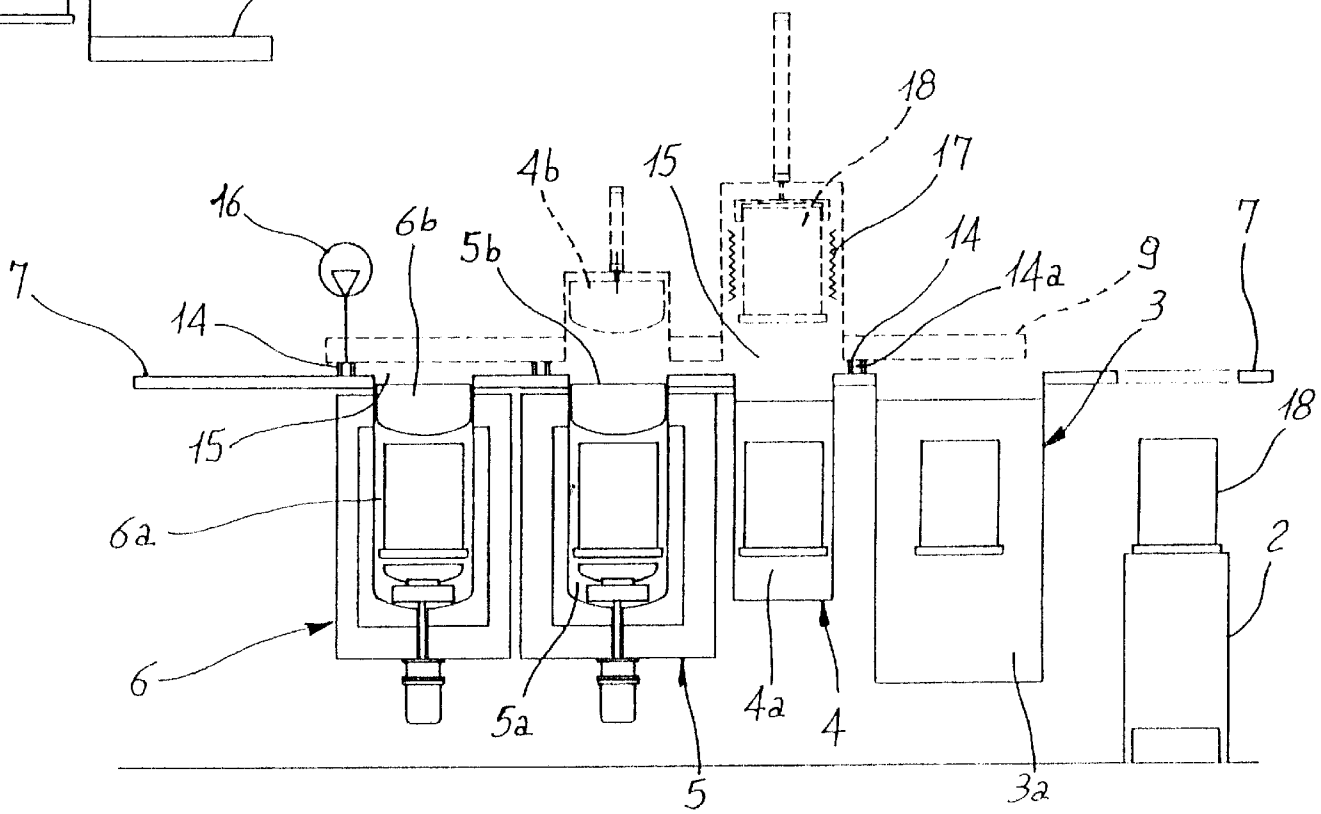
FIG. 1 is an elevation side view of a diagram of a first embodiment of the plant of the invention in which the work stations are arranged in a row.
Figure 2:
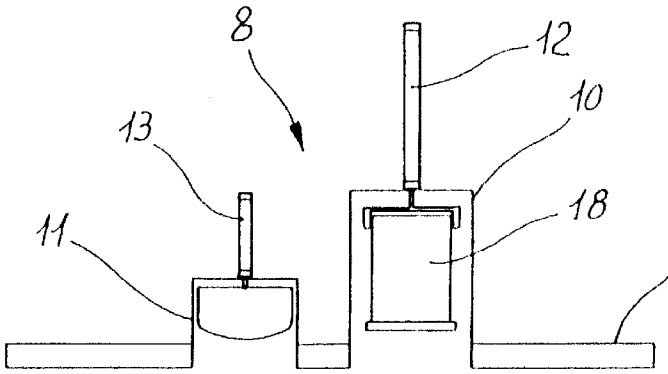
FIG. 2 shows a portion of the plant in FIG. 1.

With reference to the drawings, the automatic plant for thermal treatments in accordance with the invention is generally identified by reference numeral 1.

It comprises a loading/unloading station 2 of a charge-holding basket 18 having a predominantly vertical extension enabling very long pieces too to be processed, which pieces are suspended in a vertical position so as to limit deformation thereof during high-temperature treatments.

Disposed in a linear (see FIG. 1) or circular (see FIG. 3) succession are several work stations aligned with the loading/unloading station 2; for instance, there is one washing or rinsing station 3, one cooling station 4, one reheating and/or high-temperature thermochemical-process furnace 5, one tempering and/or low-temperature thermochemical-process furnace 6.

The above mentioned work stations have respective chambers 3*a*, 4*a*, 5*a*, 6*a* of a well-shaped conformation, i.e. with the loading/unloading opening located on top. In particular, stations 4, 5 and 6 can preferably comprise corresponding cover-shaped closure members 4*b*, 5*b* and 6*b* enabling the respective work chambers to be tightly sealed and a controlled process atmosphere to be established therein.

In addition, work stations are provided, at the upper part thereof, with a substantially flat bearing structure 7 extending horizontally above the same.

The mechanical movements of the charge-holding baskets 18 and the cover-shaped closure members 4*b*, 5*b*, 6*b* rely on a movable assembly 8 provided with a plate-like base 9 slidable close to and above the bearing structure 7 and adapted to be automatically disposed, upon command o a control unit not shown, at predetermined operating conditions.

The plate-like base 9 at the upper part thereof comprises a substantially bell-shaped first region 10 adapted to house a charge-holding basket 18 and a second region 11, also in the form of a bell, adapted to house one of the cover-shaped closure members 4*b*, 5*b*, 6*b*.

Obviously, more than one bell-shaped first region 10 and more than one bell-shaped second region 11 can be provided, depending on requirements.

In particular, at least two second bell-shaped regions will be installed when two or more cooling stations 4 or other work stations are required.

For each first bell-shaped region 10 the movable assembly 8 comprises a vertical-movement device 12 adapted to hook and release a basket 18 and to move it between an upper position internal to the bell-shaped region 10 and a lower position external thereto.

From a construction point of view the movement means 12 can be of any type, actuators cooperating with mechanical hooking systems intended for engaging basket 18, for example.

For each second bell-shaped region 11 too the movable assembly 8 comprises a device 13 for removal and repositioning of a cover-shaped closure member 4*b*, 5*b*, 6*b*, which is adapted to lift said cover within the bell-shaped region 11 and lower it to a closed position of the respective work chamber.

Device 13 too can be of any nature, of mechanical, magnetic, pneumatic type for example, and so on.

The operating means of devices 12 and 13, located at the outside of the respective bell-shaped regions, are of immediate and easy access from the upper and rear part of the plant. Passage through the bell-shaped regions of the above mentioned actuators are provided with appropriate seals adapted to ensure a perfect tightness.

Figure 3:
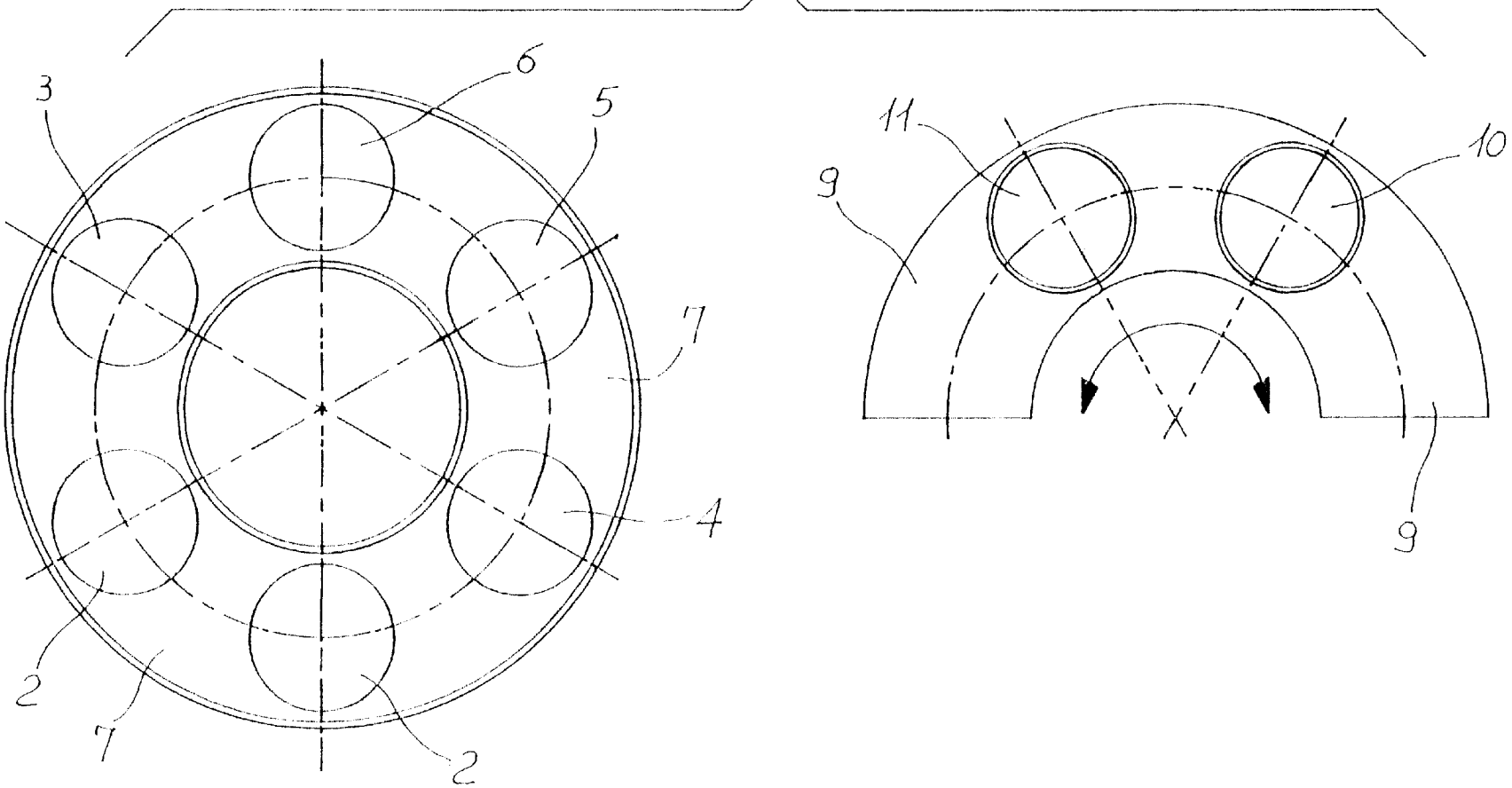
FIG. 3 is a plan view of a second embodiment of the plant having a circular arrangement of the work stations and in which the plate-like base is in the form of an arc.

Obviously, if the work stations are disposed along a path of circular course, the relative bearing structure 10 is curved in the form of an arc of a circle or of a full circle and the plate-like base 9, in a plan view, substantially has the form of an annulus and is slidable with a rotatory motion along such a curved bearing structure (see FIG. 3).

Interposed between the slidable plate-like base 9 and the flat bearing structure 7 is appropriate sealing means 14 adapted to create, during displacement of the plate-like base itself and at said operating positions of the plate-like base, hermetically sealed spaces 15 disposed close to at least one portion of the work stations and the bell-shaped regions 10 and 11.

Said sealing means may consist of seals preferably disposed in pairs, in side by side relationship, so as to maximize reliability and define a hollow space or gap 14*a* into which an inert gas (nitrogen, for example) can be introduced by means of a pumping circuit 16, in overpressure relative to both the outer environment and spaces 15. In this way, any possible reduction in tightness of the seals gives rise to an inert gas admission either to spaces 15 or to the outside without any problem.

It is however to note that the sealing means 14 can also comprise gas-cushion systems adapted to ensure both tightness and an easy movement of plate 9.

At all events, the sealing means 14 enables the atmosphere present in the work chambers 3*a*, 4*a*, 5*a*, 6*a* and within the bell-shaped regions 10 and 11 to come into contact with the ambient atmosphere mainly during the transferring operations of the charge-holding baskets 18 from a high-temperature furnace 6 to a low-temperature furnace 5 or to the cooling station 4.

A perfect seal is also ensured during the purging, washing and saturation steps of the transferring technical volumes, which steps are carried out by controlled admission of technical gases.

In order to maintain loss in temperature of the charges within a minimum value during transferring from the reheating furnaces 5 and 6 to the cooling station 4 or another work station, the first and second bell-shaped regions 10 and 11 have thermally insulated walls or thermal-insulation coverings and heating means 17 consisting of electric resistors for example.

Operation of an automatic plant for thermal treatments described above mainly as regards structure is as follows.

First of all, for hooking and lifting a charge-holding basket 18 the movable assembly 8 carries out a translation, or a rotation if the plant has a circular course, until the first bell-shaped region 10 is in alignment with the work station where basket 18 to be handled or moved is present. After centering has been completed, the vertical movement devices 12 move downwardly to a lower position, ready to hook the basket. When the hooking operation is over, the device 12 moves upwardly until the upper position. At this point the basket and the charge contained therein can be carried to the intended work station, by a linear or rotatory motion of the plate-like base 9.

When the base 9 has been aligned with the intended work station, the device 12 moves downwardly until the lower position, lays down the basket 18 at the work station in question and moves again upwardly to the upper position.

When the upward stroke has been completed, the movable assembly 8 will be able to move to and get aligned with another station for subsequent operations or stay there waiting for the unloading command from the previously loaded station.

By the above described sequence and operating modalities the movable assembly 8 can activate the device 13 for removal and repositioning of each cover-shaped closure member 4*b*, 5*b*, 6*b*. In most cases the plant contemplates a quick positioning of said cover in the respective work station, so as to restrict the loss in temperature that inevitably occurs in hot chambers during the loading and unloading operations.

The sealing means 14, during opening of a work chamber, removal of a charge therefrom, displacement and positioning of the charge to another station, closure of the previously unloaded station constantly ensures a controlled atmosphere around the charges being transferred and in the technical movement volumes.

The sealing efficiency of means 14 towards the outside and the slidable plate-like base 9, to be made following the typology of the work stations of the well-shaped type, enables the operators, in some thermochemical treatments providing use of toxic gases, to work with a process atmosphere within the hot chambers and with a protective atmosphere, an inert gas for example, within the closed spaces 15 included between the plate-like base 9 and the hot chambers themselves.

In this case appropriate washing operations with an inert gas are carried out to obtain the complete elimination of the toxic gases contained in the process chamber before opening of the relative covers for loading operations.

After the required treatment sequence has been completed, the basket with the treated pieces is automatically repositioned to the loading/unloading station 2 thereby enabling either the operator assigned to plant running or a mechanical extraction system, to remove the basket with the already treated pieces and optionally replace it with a new basket with pieces to be treated.

The invention achieves important advantages.

First of all the plant, in addition to ensuring a high homogeneity in the temperature distribution and a controlled atmosphere in the spaces above the chambers of the work stations and consequently high treatment qualities of the metal materials, has marked features as regards the modular structure because it can be easily modified or enlarged by simple interventions, through replacement or addition of work stations.

It is to note that, contrary to the known art, when plant enlargements are to be made, bigger sealingly closed chambers are not required. Therefore, the technical volumes of controlled atmosphere necessary for charge transferring are not modified because the sizes of the movable assembly and the closed spaces defined by said assembly stay substantially unchanged. In other words, the invention enables an efficient optimization in technical-gas consumption.

In particular, the possibility of aligning several cooling stations with different quenching means such as oil, fused salt, water, water with additives, forced air, hot air, protective atmosphere or others, enables accomplishment of thermal treatments that usually require purchase of special dedicated plants.

In addition, the opportunity offered by the plant of arranging a practically numberless series of loading/unloading stations, without too many modifications or too high additional costs, enables running costs to be reduced, so that the operating autonomy of the plant itself is enlarged even when the operator assigned to the loading/unloading task is completely absent.

It is to point out that, due to a barrier preventing a violent exit of hot gases from the treatment chambers and consisting of one portion of the slidable plate-like base, decrease in the inner temperature of the treatment chambers themselves is limited, which will bring about a reduction in energy consumption for restoration of the work temperatures.

It is to be added that the hermetic seal ensured both by the treatment chambers and the slidable plate-like base enables discharges from the treatment atmosphere and steam and fumes produced during the quenching steps to be conveyed to given points; then, since the chemical composition and flow rate of these discharges is known and since there are no infiltrations and alterations by external agents, appropriate and perfectly sized abatement and filtering systems can be provided.

Practically, the plant reaches surely high levels in terms of safety and ecology respect.

As regards its bulkiness too, the plant of the invention is advantageous because, in the version with chambers in a row it has a reduced width or depth. In the embodiments of circular extension the plant, while maintaining its sizes in height unchanged, offers an optimum compromise between depth and width.

It is finally to point out that the easy removability of each work station from its operating position enables a complete accessibility to each plant component and therefore also easy interventions for servicing. The devices for vertical movement of the baskets and the cover-shaped closure members can be quickly disposed at a lowered position close to a loading/unloading station and thus made easily accessible for controls and maintenance.

What is claimed is:

1. An automatic plant for thermal treatments of metal materials, comprising at least one loading/unloading station (2) and work stations (3, 4, 5, 6) provided with chambers (4*a*, 5*a*, 6*a*) having a well-shaped configuration, further comprising:

a flat bearing structure (7) extending horizontally and in superposed relationship with said stations, and a movable assembly (8) provided with a slidable base (9) close to said flat bearing structure (7) and adapted to be disposed at operating positions, said base (9) having at least one first substantially bell-shaped region (10) adapted to house a charge-holding basket (18), and said movable assembly (8) comprising, for each said bell-shaped region (10), a vertical-movement device (12) to move the basket (18) between an inner upper position and an outer lower position relative to the bell-shaped region (10) itself.

2. The plant as claimed in claim 1, wherein said base comprises at least one second substantially bell-shaped region (11) adapted to house a cover-shaped closure member (4*b*, 5*b*, 6*b*) of a work chamber, and in that said movable assembly (8) for each said second bell-shaped region (11) comprises a removal and repositioning device (13) for a cover-shaped closure member.

3. The plant as claimed in claim 1 or 2, wherein interposed between said slidable base (9) and said flat bearing structure (7) is sealing means (14) to create, during displacement of the plate-like base (9) and at said operating positions, hermetically sealed spaces (15) disposed at at least one portion of said stations (3, 4, 5, 6) and said bell-shaped regions (10, 11).

4. The plant as claimed in claim 3, wherein said sealing means (14) comprises a gas-cushion system for enabling sliding of the base (9) with minimum friction.

5. The plant as claimed in claim 1, wherein at least said first bell-shaped region (10) has thermally insulated walls.

6. The plant as claimed in claim 5, wherein in said thermally insulated walls provision is made for heating means (17).

7. The plant as claimed in claim 2, wherein said second bell-shaped region (11) has a thermal insulating covering.

8. The plant as claimed in claim 1, wherein said loading/unloading and work stations (2, 3, 4, 5, 6) are disposed along a path of circular extension defined by a bearing structure (7) in the form of an arc of a circle, and in that said base (9) has a substantially annulus-shaped conformation in plane view and is slidable with a rotatory motion on said arc-shaped bearing structure.

9. The plant as claimed in claim 1, wherein said loading/unloading and work stations (2, 3, 4, 5, 6) are disposed in a row, and in that the bearing structure (7) and base (9) are of a substantially rectilinear underlying configuration, said base (9) being slidable with a rectilinear motion on said bearing structure (7).

10. The plant as claimed in claim 1, wherein the metal material is steel and the base (9) has a substantially plate configuration.

11. The plant as claimed in claim 3, wherein the metal material is steel and the base (9) has a substantially plate configuration.

12. The plant as claimed in claim 4, wherein the metal material is steel and the base (9) has a substantially plate configuration.

13. The plant as claimed in claim 5, wherein the metal material is steel and the base (9) has a substantially plate configuration.

14. The plant as claimed in claim 6, wherein the metal material is steel and the base (9) has a substantially plate configuration.

15. The plant as claimed in claim 8, wherein the metal material is steel and the base (9) has a substantially plate configuration.

* * * * *